United States Patent [19]

Westfall

[11] 4,013,861

[45] Mar. 22, 1977

[54] MICROWAVE OVEN DOOR SEAL

[75] Inventor: John Lloyd Westfall, Shreveport, La.

[73] Assignee: The Frymaster Corporation, Shreveport, La.

[22] Filed: Aug. 13, 1975

[21] Appl. No.: 604,259

[52] U.S. Cl. ..... 219/10.55 D
[51] Int. Cl.[2] ..... H05B 9/06
[58] Field of Search ..... 219/10.55 D, 10.55 B; 174/35 GC, 35 MS, 35 R

[56] References Cited

UNITED STATES PATENTS

| | | | |
|---|---|---|---|
| 2,958,754 | 11/1960 | Hahn | 219/10.55 D |
| 3,431,348 | 3/1969 | Nellis et al. | 219/10.55 D |
| 3,629,537 | 12/1971 | Haagensen | 219/10.55 D |
| 3,809,843 | 5/1974 | Takayama | 219/10.55 D |
| 3,812,316 | 5/1974 | Milburn | 219/10.55 D |
| 3,835,283 | 9/1974 | Suzuki | 219/10.55 D |
| 3,846,608 | 11/1974 | Valles | 219/10.55 D |
| 3,985,993 | 10/1976 | Imberg et al. | 219/10.55 D |

OTHER PUBLICATIONS

*How Amana Keeps Oven Leakage To A Microtrickle,* Appliance Manufacturer, Sept. 1970, pp. 76–78.
TDK Ferrite Absorber, TDK Electronics Co. Ltd. Rec'd PTO Aug. 3, 1971.

*Primary Examiner*—Arthur T. Grimley
*Attorney, Agent, or Firm*—Dennis L. Mangrum

[57] ABSTRACT

The present invention is a device for sealing the door of a self-cleaning combination thermal and microwave oven from microwave energy leakage. The invented device provides in combination a wavelength choke, a conductive gasket and a microwave absorber. The choke and gasket suppress the ISM band radiation and most of the out of band radiation while the microwave absorber suppresses the balance of the out of band radiation which may result by improper door closure. The combination is particularly useful in combination microwave and thermal self-cleaning ovens where high temperatures cause expansion and stress not normally encountered in microwave ovens.

5 Claims, 4 Drawing Figures

MICROWAVE OVEN DOOR SEAL

BACKGROUND OF THE INVENTION

1. Field of the Invention

The invention relates generally to microwave ovens and specifically to combination microwave and thermal ovens.

2. Prior Art

In microwave oven design and construction the ability to prevent microwave energy leakage is a major concern. Leakage must be prevented in microwave ovens in order to protect users from exposure to that energy. Federal standards require that the radiation leakage be less than 1 milliwatt per square centimeter at 5 centimeters distance from the microwave oven door, for the fundamental ISM band and less than 25 microvolts per meter at a at a distance of 1,000 feet for all out of band radiation.

Microwave energy will not transmit through solid metal. Therefore, the oven cavity and door in microwave ovens are formed from metal. Since the door and oven are not formed as a unified member, leakage may occur through the joint between the door and the wall of the oven cavity. In ovens where the only cooking energy is microwave, a seal can be effectively formed which will conductively seal the door and wall of the oven cavity and thereby prevent leakage of the microwave energy. In some prior art microwave ovens a flexible gasket is used to prevent that leakage. In other prior art microwave ovens a choke which causes an electrical short is employed. However, when an oven is constructed which employs both microwave energy and thermal energy for cooking, no sealing device has been designed or constructed which will effectively prevent microwave leakage. The problem results because high temperatures cause stress and expansion of the cavity walls and gasket which reduces the contact area between the gasket and cavity wall and thereby permits leakage of microwave energy. This thermal expansion problem is significantly increased when the self-cleaning feature is added to ovens employing both thermal and microwave energy. In these ovens, the temperature during the self-cleaning cycle will vary between 865° and 1,000° Fahrenheit. At these high temperatures the metal walls and faces of the oven are subjected to expansion and stresses not normally found in ovens only utilizing microwave energy. These stresses and expansions cause the alignment of the sealing mechanisms to change. There is no known oven which employs both thermal and and microwave energy in a self-cleaning oven which operates in the 2.450 GHz ISM band, and accordingly, there is no known device for sealing the door of such an oven.

It is acknowledged that in the prior art some microwave ovens employ chokes as electrical shorts; some employ flexible conductive gaskets, and others employ a microwave absorbing cartridge. However, none of those prior art devices employ any combination of the various techniques for sealing the door of the oven. Moreover, the present invention provides a one-half wave-length choke. This specific wave length choke is constructed such that minimum energy levels exist near the door gasket. This design prevents build-up of energy near the door gasket which could cause destruction of the gasket and thereby reduce the effectiveness of the combined choke and gasket which eliminates most of the total ISM band leakage.

The present invention overcomes the problems that exist in the prior art and provides an efficient sealing device for a combination thermal-microwave oven.

SUMMARY OF THE INVENTION

A device for preventing leakage of microwave energy from the door of a combination thermal and microwave oven is disclosed. The invented device is comprised of: a one-half wavelength choke, a flexible conductive gasket and a microwave absorbing block. The one-half wave length choke acts as an electrical short and when matched with a conductive gasket suppresses the majority of the ISM band microwave energy directed at the joint between the door and the oven cavity. The microwave absorbing block suppresses the remainder of the microwave leakage. In combination these devices are effective in sealing a thermal microwave oven even when extremely high temperatures are used for self-cleaning.

It is an object of the present invention to provide a device which will suppress the radiant leakage of microwave energy from the joint between the door and oven cavity walls of a combination microwave and thermal oven.

It is another object of the present invention to provide a device for suppressing the radiant leakage of microwave energy in a combination thermal microwave oven which uses extremely high temperatures for self-cleaning.

It is another object of the present invention to provide a sealing device which will reduce the radiation of microwave energy to less than 1 milliwatt per square centimeter at 5 centimeters distance from the oven door for the fundamental ISM band and less than 25 microvolts per meter at 1,000 feet distance for all out of band radiation.

It is still another object of the present invention to provide a one-half wave length choke which will force minimum energy to exist at the flexible gasket and thereby prohibit destruction of that gasket because of high energy levels which might otherwise exist.

DETAILED DESCRIPTION OF THE PREFERRED EMBODIMENT

Figure 1:
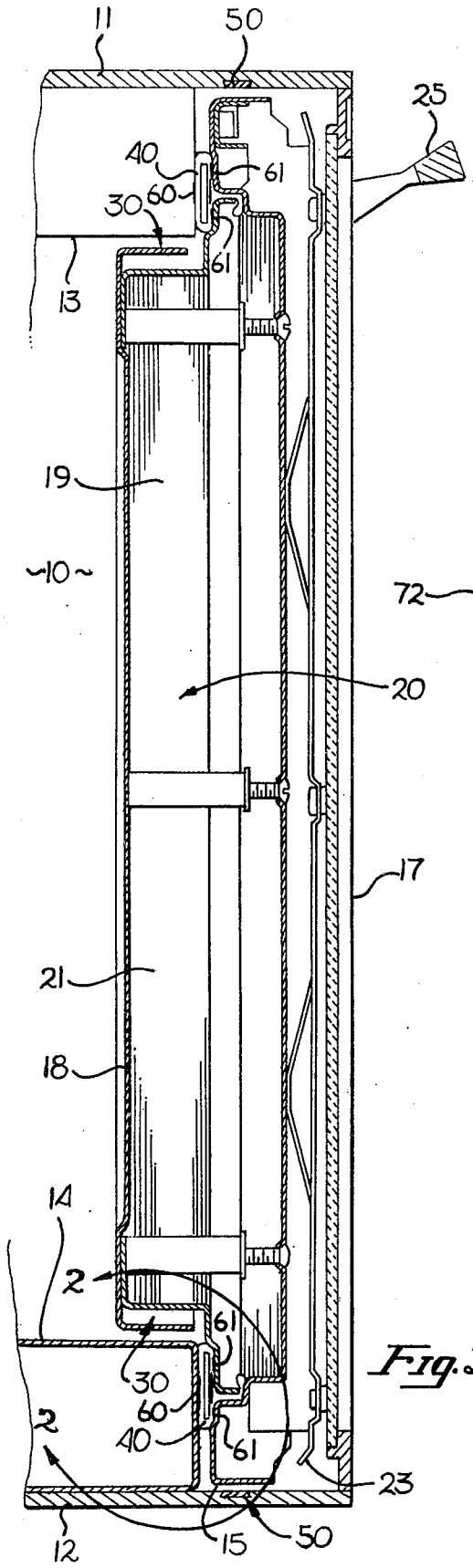
FIG. 1 is a cross-sectional view of the oven and oven door, illustrating the relative locations and structure of the present invention.

Referring first to FIG. 1, the environment and relative location of the present invention in respect to the oven cavity is shown. The oven cavity 10 is defined by outer walls 11 and 12, inner walls 13 and 14 and a back and two side walls, not shown. The door 20 is shown in its closed position. The microwave leakage suppressing device of the present invention is comprised of a choke 30, a flexible conductive gasket 40 and a Ferrite impregnated rubber cartridge 50. The relative positions and placement are illustrated in FIG. 1.

In the design and construction of microwave ovens, Federal law restricts the amount of leakage of microwave energy that can be emitted from the oven. Those requirements limit the radiation to less than one milliwatt per square centimeter at 5 centimeter's distance from the door for the fundamental ISM band and less than 25 microvolts per meter at 1,000 feet distance for all out of band radiation. Radiation of microwave energy can be eliminated if the oven cavity is totally enclosed by metal. However, the oven cavity must have a door in order to be operational, and, hence, the joint between the walls of the oven cavity and door become a source of leakage of microwave energy.

Referring now to FIG. 1, the door will be described, it being understood that the door could be constructed in many alternate manners to achieve the same results. Thus, a typical oven door is described herein.

The oven door 20 is formed from metal and has an outer surface 17 and an inner surface designated generally as 18. The inner surface 18 is porcelain or another suitable dielectric material. The outer surface is for decoration only. Insulation 19 and 21 is disposed there between to prevent loss of thermal energy. A latch 25 is provided for locking the door. The latch may be electronically controlled to prevent opening of the door while the self-cleaning cycle is in operation. The door pivots on hinges (not shown) around its lower portion designated generally as 23. The door has a highly conductive strip 61 formed thereon. It traverses the entire perimeter of door 20 as shown in FIG. 1, and is coupled directly to the metal of the door making electrical contact therewith. Fabrication of the strip is described hereinafter.

The oven cavity 10 may also be formed similar to oven cavities well-known in the prior art, with one modification being necessary. That modification is the high conductive strip 60 which is disposed around the perimeter of the oven cavity. Strip 60 is normally formed after the porcelain finish has been applied. However, strip 60 must be conductively connected to wall 15. Thus, during porcelain application that area is masked. In the preferred form, the strip is aluminum loaded porcelain, but it could be formed from any substance which is conductive and not subject to break-down at temperatures in the operating range of the oven. Strip 61 is form similar to strip 60.

Figure 2:
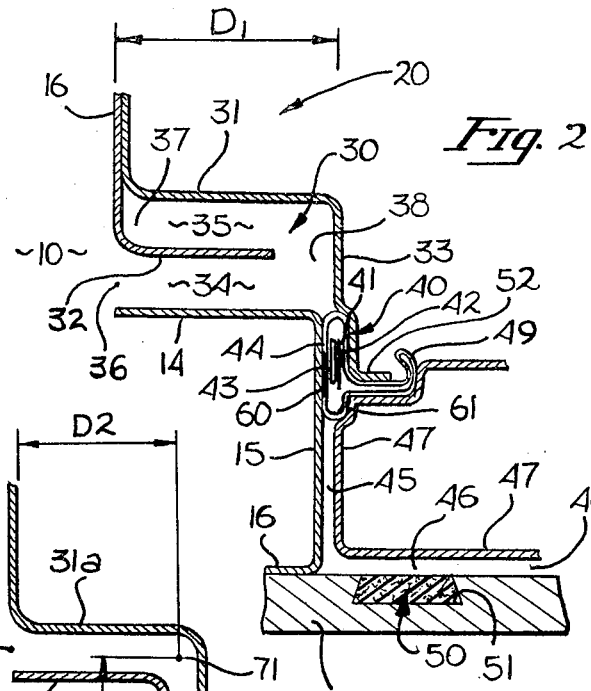
FIG. 2 is a partial blown-up cross sectional view taken within the circumscribed area labeled 2—2 of FIG. 1.

The leakage path formed by the joint can best be described in reference to FIG. 2. Any leaking microwave energy must pass from the oven cavity and along the areas labeled 34, 45 and 46. If the escaping microwave energy reaches point 48 it will be radiated from the oven door. The present invention is comprised of 3 components which operate in combination to eliminate leakage. Removal of any individual component would incapacitate the system. The 3 three components for suppressing the leakage of microwave energy are disposed along the joint. The device must be constructed to operate under adverse conditions and have a very low failure rate. The gasket must be capable of effecting a conductive seal between the door and oven wall even if food stuff or other debris is introduced along its contact area. The gasket must also be capable of maintaining that seal at all times and especially during high temperature cycles which create expansion and stress.

The present invention employs in combination a choke 30, a sealing gasket 40 and an absorbing cartridge 50, each of which will be described in detail herein below. The choke 30 of the present invention is defined by interior oven wall 14, door walls 31, 33 and 32 and gasket 40, as illustrated in FIG. 2. The door wall 32 is spaced apart from door wall 31 and is an extension forming an enclosed area 35 having one open end 38. Enclosed area 35 is terminated at 37 by wall 16 forming a solid barrier with wall 18. Thus, a generally U-shaped area is formed in which microwave energy may travel. The length of each side of the U-shaped choke 30 is designated as $D_1$. In the presently preferred embodiment distance $D_1$ is equal to the length of one-quarter of the wave length of the generated microwave energy. Thus, the total length of the choke is one-half wave length between point 36 and point 37. Since the walls 32, 14, 31 and 33 are metal, microwave energy emitted from the oven will traverse along paths 34 and 35 to point 37 and be reflected back on the same path. As that energy is reflected back to point 36 it acts as an electrical short thereby reducing the energy entering path 34.

In the presently preferred form, the length and construction of the choke 30 forces minimum energy to occur at point 38 and maximum energy to occur at points 36 and 37. It is important that minimum energy occur at point 38 since it is in that area the flexible conductive gasket 40 is disposed. If maximum energy occurred at point 38, the probability that gasket 40 would be destroyed after a very short usage is highly probable. If gasket 40 is destroyed, choke 30 cannot function since microwave energy will traverse between the choke and oven wall 15 and along the area designated as 45 and pass out of the oven rather than being forced along path 35 and reflected back to point 36 to act as the electrical short.

In the presently preferred form, the gasket 40 is formed having an aluminum strip 41 as the core. A stainless steel spring 42 is disposed adjacent to core 41. A mat 43 of fiberglass is then disposed adjacent to the spring and core and a Inconel knitted outer jacket 44 is disposed about the mat 43. The gasket is formed having a main body which contains the core and spring and a tip 49 which extends perpendicular therefrom. The main portion of the gasket is positioned such that the longitudinal axis of the core 41 is disposed parallel to the oven door and interior wall 15 of the oven cavity. The tip 49 is disposed between wall 47 and 33 of the door and secured therein by tip 49 being disposed around tip 52 of wall 33.

The gasket 40 is disposed around the entire perimeter of the oven door as heretofore described. This forms a complete seal around the door. When the door is positioned into the closed position as shown in FIG. 1, the metal gasket is compressed against the conductive strip 60 which is disposed on interior wall 15 and the conductive strip 61 on surface 33 and 47 of door 20. Spring 42 is slightly compressed such that it urges the outer jacket into contact with conductive strips 60 and 61. In the presently preferred form, metal to metal contact, between the door 20 and cavity wall 15 must exist or leakage of microwave energy will occur. When an effective seal is created between the wall 15 and door 20 by gasket 40 microwave energy will not leak therefrom and the gasket will effectively seal the cavity and create the electrical short in conjunction with choke 30. However, if gasket 40 does not function, choke 30 will not operate and no seal will exist.

In ovens which only use microwave energy to cook, the gasket previously described would be effective unless food stuff or other debris caused the gasket not to seal. If the gasket doesn't seal for some reason, leakage will occur unless additional protection is provided. The problem becomes more acute in ovens which use both thermal and microwave energy for cooking; and even more acute in self-cleaning ovens which have temperatures ranging between 865° and 1,000° Fahrenheit. At these high temperatures the metal walls in the oven, such as 15, 14, and 16 are subjected to expansion and stress not normally found in non-thermal ovens. The stresses and expansions cause the alignment and sealing of the gasket and wall to change; and, hence, the possibility of leakage of microwave energy.

In order to stop leakage that may occur from the gasket and choke, the present invention employs a microwave absorbing cartridge 50 which is disposed in the outer wall 12 of the oven, such that any leaking microwave energy must pass thereby. Cartridge 50 is formed from a ferrite impregnated rubber in the presently preferred embodiment. In alternate embodiments, different microwave absorbing material may be employed. The efficiency of the material used will determine the cartridges efficiency and different materials can be used effectively depending on their dielectric and energy absorbing capabilities. Cartridge 50 is disposed in aperture 51 of wall 12 such that one face of the cartridge forms a portion of the wall and defines a portion of the area labeled 46.

The presently preferred embodiment of the invention has been described as having a one-half wave length choke, however, in an alternate embodiment a choke having a different magnitude could equally well be employed. The only restriction being that in any alternately formed choke the minimum energy level exists at the region near gasket 40. Alternately microwave absorbing cartridge 50 can be disposed at various positions along the areas designated 45 and 46 and equally well be as effective. In other forms, gaskets of different materials may equally well serve to provide the conductive contact and barrier for the microwave energy. The invented device is comprised of the choke, gasket and absorber in combination such that each element functions independently and in cooperation with each other element.

Figure 3:
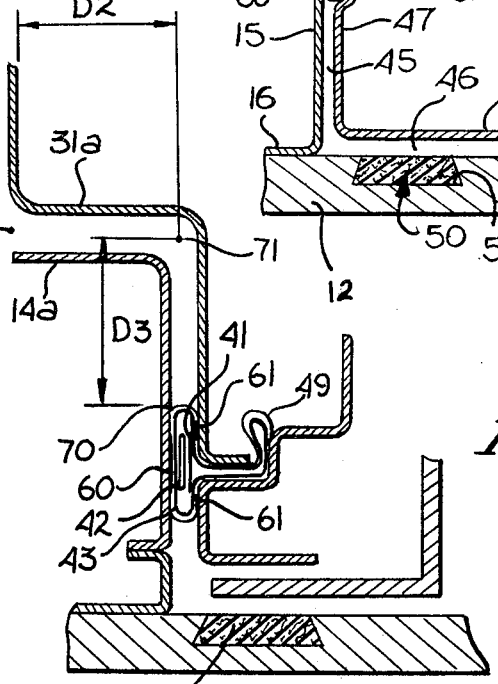
FIG. 3 is an alternate embodiment of the invention illustrating an alternate placement of the flexible conductive gasket.

The first alternate embodiment is illustrated in FIG. 3. There the metal gasket is displaced from its position as illustrated in FIG. 2 such that distance $D_3$ exists between the end 70 of the metal gasket and point 71 located at the juncture of walls 15 and 14. The distance $D_2$ between point 70 and 72 is constructed such that the total distance $D_2$ plus $D_3$ is equal to one-half the length of a wave length.

Figure 4:
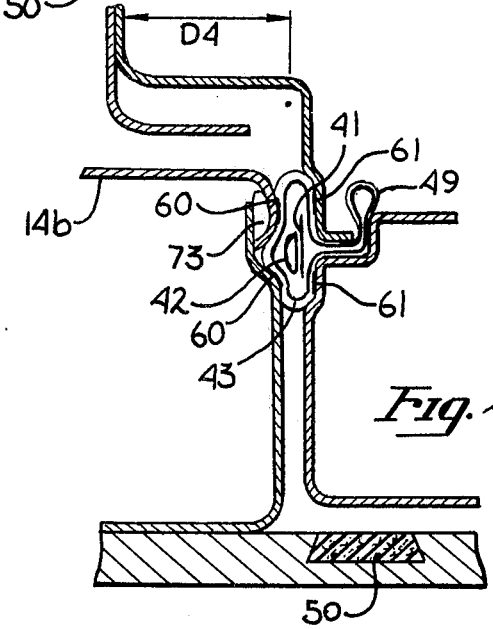
FIG. 4 is a second alternate embodiment of the present invention.

In the second alternate embodiment illustrated in FIG. 4 a metal squeeze gasket 73 is forced to contact sides **14*b* and 15*b*** to form a electrical contact therebetween. The construction of the inner walls of the oven cavity in this manner permits a much smaller sheet of metal to be employed in the construction of the oven cavity and may be economically more feasible than the presently preferred embodiment. Here $D_4$ is equal to the distance $D_1$ or one-quarter of the length of the wave length.

However, while the preferred embodiment of the present invention has been described in detail herein, it will be understood by those skilled in the art that various changes in form and detail may be made therein without departing from the spirit and scope of the invention.

I claim:

1. A device for suppressing leakage of microwave energy from the space defined by a door and a wall of an oven cavity of a combination thermal microwave oven, said device comprising:

a. a flexible conductive gasket for conductively sealing said door to said wall of said cavity;

b. a choke means for electrically shorting leaking microwave energy passing between said door and said wall of said cavity, said choke means disposed around said door and formed from said wall of said cavity, said door and said flexible conductive gasket, said choke formed such that minimum current in the electrical short occurs near said flexible conductive gasket;

c. a means for absorbing the microwave energy leaking from said oven cavity and by-passing said flexible conductive gasket and said choke means;

Whereby said flexible conductive gasket maintains physical and conductive contact with said wall of said oven cavity, thereby maintaining the integrity of said choke means.

2. The device of claim 1 wherein escaping microwave energy bypasses in order; said choke means, said flexible conductive gasket and said means for absorbing microwave energy.

3. The device of claim 1 wherein said choke means is a one-half wave length choke.

4. The device of claim 1 wherein said microwave absorbing means is comprised of ferrite impregnated rubber.

5. A device for suppressing leakage of microwave energy from the space defined by a door and a wall of an oven cavity of a combination thermal microwave oven in which high temperatures are employed for self cleaning, said device comprising;

a. a flexible conductive gasket for conductively sealing the perimeter of said door to said wall of said cavity;

b. a one-half wavelength choke means for electrically shorting leaking microwave energy passing between said door and said wall of said oven cavity, said choke means defined by said door, said wall of said oven cavity and said flexible conductive gasket, said choke means disposed around the perimeter of said door such that minimum current in the electric short occurs near said flexible conductive gasket; and, c. a means for absorbing the microwave energy leaking from said oven cavity and by-passing said choke means, and said flexible conductive gasket, said means comprised of ferrite impregnated rubber, said means disposed in the path of said leaking microwave energy;

Whereby, said flexible conductive gasket maintains physical and conductive contact with a wall of said oven cavity thereby maintaining the integrity of said choke means.

* * * * *